US011187246B2

(12) United States Patent
Choi et al.

(10) Patent No.: US 11,187,246 B2
(45) Date of Patent: Nov. 30, 2021

(54) FAN MOTOR

(71) Applicant: LG Electronics Inc., Seoul (KR)

(72) Inventors: Joongkeun Choi, Seoul (KR); Giyeob Yang, Seoul (KR); Jeong Ho Lee, Seoul (KR); Seong-Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 97 days.

(21) Appl. No.: 16/657,417

(22) Filed: Oct. 18, 2019

(65) Prior Publication Data

US 2020/0124055 A1 Apr. 23, 2020

(30) Foreign Application Priority Data

Oct. 19, 2018 (KR) ..... 10-2018-0125502

(51) Int. Cl.

| | |
|---|---|
| ***F04D 29/58*** | (2006.01) |
| ***F04D 29/32*** | (2006.01) |
| ***F04D 17/16*** | (2006.01) |
| ***A47L 9/22*** | (2006.01) |

(52) U.S. Cl.

CPC ..... *F04D 29/584* (2013.01); *A47L 9/22* (2013.01); *F04D 17/168* (2013.01); *F04D 29/325* (2013.01)

(58) Field of Classification Search

None

See application file for complete search history.

(56) References Cited

U.S. PATENT DOCUMENTS

| | | | | |
|---|---|---|---|---|
| 2018/0177373 | A1* | 6/2018 | Hayamitsu | F04D 29/4253 |
| 2018/0216635 | A1 | 8/2018 | Hayamitsu | |
| 2018/0266426 | A1* | 9/2018 | Lee | F04D 29/403 |

FOREIGN PATENT DOCUMENTS

| | | |
|---|---|---|
| EP | 3376043 | 9/2018 |
| JP | 2006104976 | 4/2006 |
| JP | 2018123738 | 8/2018 |
| KR | 20180105934 | 10/2018 |
| TW | 483495 | 4/2002 |
| TW | I630328 | 12/2017 |

OTHER PUBLICATIONS

Taiwan Office Action in Taiwan Appln. No. 108136683, dated Oct. 5, 2020, 12 pages (with English translation).

Extended European Search Report in European Appln. No. 19202119.4, dated Apr. 28, 2020, 7 pages.

* cited by examiner

*Primary Examiner* — Juan G Flores

(74) *Attorney, Agent, or Firm* — Fish & Richardson P.C.

(57) ABSTRACT

A fan motor comprises a motor mount, a motor part accommodated in an inner space of the motor mount, and an impeller disposed above the motor mount. The motor mount defines: an air discharge opening configured to discharge air discharged from the impeller to an outer space of the motor mount; a cooling flow path outlet disposed at the upper side of the motor mount at a position between the impeller and the air discharge opening; and a first cooling flow path inlet disposed at a position below the air discharge opening and the cooling flow path outlet. The fan motor further includes a guide that is configured to direct, to an upward direction, at least a portion of air that is discharged through the air discharge opening and introduced to the inner space through the first cooling flow path inlet.

20 Claims, 8 Drawing Sheets

FAN MOTOR

CROSS-REFERENCE TO RELATED APPLICATIONS

This application claims the priority of Korean Patent Application No. 10-2018-0125502, filed on Oct. 19, 2018, in the Korean Intellectual Property Office, the disclosure of which is hereby incorporated by reference in its entirety.

FIELD

The present disclosure relates to a fan motor with an integrated motor and fan, and more particularly to a fan motor structure capable of increasing power of a motor and cooling the motor smoothly while reducing the size and weight of the fan motor.

BACKGROUND

A fan motor is a device including a motor which can produce a torque, and a fan which is rotated by the motor to generate an air flow. Fan motors are widely being used for home appliances that use an air flow. A vacuum cleaner is an example of such home appliances.

A conventional vacuum cleaner may include a main body provided with a fan motor that is separated from a suction duct provided with a suction port. A handheld vacuum cleaner may include a fan motor integrated with a suction duct, which may reduce a user convenience if the fan motor is heavy.

From a standpoint of the user convenience, a lightweight fan motor may be provided for the handheld vacuum cleaner. However, the lightweight fan motor may have a problem of poor suction capability due to its low power.

Therefore, attempts have been made to increase the power of the fan motor while reducing its size and weight. A high-speed rotation of the fan motor is important for increasing the power of the fan motor while reducing its size and weight. However, the high-speed rotation may cause problems such as noise, vibration and heat generation.

In some examples, vibrations of a fan motor are caused due to the arrangement of a rotating shaft of a motor part. In order to support the rotating shaft that rotates at high speeds, a metal-based frame structure with high rigidity is required. However, the frame structure leads to an increase in the weight of the fan motor. Additionally, it is difficult to apply a structure, which guides a flow of air and which has a streamlined shape, to a metal-based frame when manufacturing and processing the fan motor.

Accordingly, in relation to a structure supporting a rotating component, an air flow path of a fan motor has to be configured such that the air flow path may not be formed at a position in which a metal-based component is disposed while the metal-based component with high rigidity is used.

When a motor part rotates at high speeds in a scale-down motor housing, more heat is generated in a narrower space. In this case, efficient cooling is required. However, to cool the heat generated in the fan motor due to the high-speed rotation, some of the power of the fan motor may be used for heat dissipation of the fan motor, which may cause a problem of reduction of the motor power used for a suction force of the vacuum cleaner. In some examples where an air flow generated by the rotation of the fan motor forms a flow path to directly cool the fan motor, there may be an increase of the flow resistance at the exhaust side of the fan motor, which may deteriorate suction force of the fan motor. A reduction in the suction force may lead to an increase in the size of the motor part. This is contrary to the trend toward a reduction in the size and weight of a fan motor structure.

Thus, there is a growing need for a fan motor structure in which airflow resistance can be minimized, power of a motor part can be used for suction force of a fan motor to a maximum degree, heat generated in the motor part rotating at high speeds can be sufficiently cooled, without directly using some of the power of the motor part to cool the motor.

SUMMARY

It is an object of the present disclosure to provide a fan motor structure with a reduced size and weight while maintaining its suction force.

It is another object of the present disclosure to provide a fan motor structure in which in relation to a structure supporting a rotating component, an air flow path of a fan motor can be configured such that the air flow path may not be formed at a position in which a metal-based component is disposed while the metal-based component with high rigidity is used, and which can be lightweight and can be readily manufactured.

It is another object of the present disclosure to provide a fan motor structure that can minimize a length of an air flow path such that air flow losses generated at the rear end of an impeller may be minimized while suction force of the fan motor may be ensured by rotating the fan motor at high speeds, and that can have a reduced sized and weight.

It is another object of the present disclosure to provide a fan motor structure including a cooling flow path structure of a motor part, which can minimize reduction of motor power and fan suction force and can supply air for cooling the motor part smoothly by generating an air flow for cooling heat generated in the motor part of the fan motor.

It is another object of the present disclosure to provide a fan motor structure that can simplify a process of manufacturing of a fan motor while reducing its size and weight.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

According to one aspect of the subject matter described in this application, a fan motor for a vacuum cleaner may include an impeller that is rotated by a motor part and that is provided at the upper side of a motor mount configured to accommodate the motor part. A cooling flow path inlet is provided at a lower side of the motor mount, and a cooling flow path outlet is provided at an upper side of the motor mount. Air pressurized by the impeller is discharged through an air discharge opening out of the motor mount. A part of the air discharged out of the motor mount is introduced into the motor mount through the cooling flow path inlet. A guide shape directs the air, introduced into the motor mount through the cooling flow path inlet, toward the motor part. The air directed toward the motor part is discharged to a space between the impeller and the air discharge opening through the cooling flow path outlet.

Specifically, a fan motor for a vacuum cleaner may include a motor mount configured to accommodate a motor part, where the motor mount defines a cooling flow path inlet that is located at least one of a lateral side or a lower side of the motor mount and that is configured to receive air to reduce heat generated in the motor part, an impeller located vertically above the motor part and configured to be rotated by the motor part, an impeller cover disposed vertically above the motor mount and configured to cover the impeller, where the impeller cover defines an air inlet at an upper central portion of the impeller cover, an air discharge opening defined at the motor mount and exposed to an outer space of the motor mount, where the air discharging opening is configured to discharge air that is suctioned through the air inlet and pressurized by the impeller to the outer space of the motor mount, and a cooling flow path outlet defined vertically above the motor mount and that is in fluid communication with an inner space of the motor mount and a space defined between the impeller and the air discharge opening. The cooling flow path inlet is configured to introduce air from the outer space of the motor mount into the inner space of the motor mount to cool the motor part, and the cooling flow path outlet is configured to discharge air from the inner space of the motor mount toward a space that is defined between the impeller and the air discharge opening based on the space between the impeller and the air discharge opening having a lower pressure than the inner space of the motor mount.

Implementations according to this aspect may include one or more of the following features. For example, the fan motor may further include a diffuser located between the impeller and a motor body part, where the impeller cover covers the diffuser and the impeller. The impeller may include a mixed-flow type fan, and the diffuser may be a mixed-flow type diffuser including an inclined surface that is inclined downward with respect to a center of the impeller. In some examples, a lower end of the diffuser may contact an upper end of the motor mount. The diffuser may include a diffuser body and a vane located on an outer surface of the diffuser body, and the outer surface of the diffuser body and an inner surface of the impeller cover may define a flow passage that allows air pressurized by the impeller to flow. The diffuser body may define the cooling flow path outlet, and the cooling flow path outlet may be positioned closer to the impeller than to the vane based on the diffuser being coupled to the impeller.

In some implementations, the diffuser body may include an inclined portion facing toward the impeller and being inclined downward with respect to the impeller, and a cylindrical portion extending downward from an outer edge of the inclined portion, where the inclined portion defines the cooling flow path outlet, and the cylindrical portion defines the vane.

In some examples, the air discharge opening may be interposed between a lower edge of the impeller cover and an upper edge of the motor mount. The motor mount may include a connecting arm that extends outward from an upper side of the motor mount and that is configured to couple the impeller cover to the motor mount. The motor mount further may include a body coupler that extends from a distal end of the connecting arm and that is configured to face the impeller cover based on the motor mount coupling to the impeller cover. The impeller cover may include a ring-shaped cover coupler at a lower edge of the impeller cover, and the body coupler may have a ring shape corresponding to the ring-shaped cover coupler.

According to another aspect, a fan motor for a vacuum cleaner may include a motor body part including a motor mount that is configured to accommodate a motor part, a diffuser disposed vertically above the motor body part, an impeller disposed vertically above the diffuser and configured to be rotated by the motor part, and an impeller cover disposed above the motor body part and configured to cover the impeller and the diffuser. An outer surface of the diffuser and an inner surface of the impeller cover define a flow passage configured to flow air pressurized by the impeller, and the diffuser defines a cooling flow path outlet configured to discharge air from the motor mount to the flow passage based on the flow passage having a lower pressure than an inner space of the motor mount.

Implementations according to this aspect may include one or more of following features. For example, the motor mount may define a cooling flow path inlet in at least one of a lateral side or a lower side of the motor mount, where the cooling flow path inlet is configured to receive air to reduce heat generated in the motor part. The motor mount may define an air discharge opening that is open toward an outer space of the motor mount and that is configured to discharge air flowing through the flow passage toward the outer space of the motor mount. A lower end of the impeller cover is located outside an upper side of the motor mount in a radial direction, and the air discharge opening may be located in a space between the lower end of the impeller and the upper side of the motor mount.

In some implementations, the diffuser may include a diffuser body defining the cooling flow path outlet, and a vane located on an outer surface of the diffuser body, where the cooling flow path outlet is positioned closer to the impeller than to the vane based on the diffuser being coupled to the impeller.

According to another aspect, a fan motor for a vacuum cleaner may include a motor body part including a motor mount that defines a cooling flow path inlet at a lower side or a lateral side of the motor mount, where the cooling flow path inlet is configured to introduce air to the motor mount, a motor part accommodated in the motor mount and configured to generate a torque, an impeller located vertically above the motor part and configured to be rotated by the torque generated by the motor part, a diffuser disposed between the impeller and the motor body part and configured to guide air pressurized by the impeller to an outer space of the motor mount, the diffuser contacting the motor body part, and an impeller cover coupled to an upper side of the motor body part and configured to cover the impeller and the diffuser, where the impeller cover defines an air inlet at an upper central portion of the impeller cover. The diffuser defines a cooling flow path outlet configured to discharge the air introduced to the motor mount to an upper space of the diffuser.

Implementations according to this aspect, the motor body part may further include a bearing housing accommodating a bearing that is coupled to the motor mount at an upper side of the motor mount and that is configured to support a shaft of the motor part, where the bearing housing is configured to seat the diffuser at an upper side of the bearing housing. The impeller cover and the motor mount may define an air discharge opening located between a lower edge of the impeller cover and an upper edge of the motor mount, and configured to discharge air pressurized by the impeller. The motor mount may include a body coupler radially spaced apart from an outer circumferential surface the motor mount at the upper edge of the motor mount, the body coupler being configured to couple to the lower edge of the impeller cover, and the air discharge opening may include a space between the outer circumferential surface of the motor mount and the body coupler.

According to another aspect, a fan motor for a vacuum cleaner includes a motor housing that includes a motor mount configured to accommodate a motor part, a body coupler spaced apart from the motor mount further outward than the motor mount at an upper edge of the motor mount, and a connecting arm configured to couple an upper side of the motor mount and the body coupler; an impeller disposed at an upper side of the motor housing and rotated by the motor part; and an impeller cover defining an air inlet at an upper side of the impeller cover, including a cover coupler at a lower edge of the impeller cover, configured to cover the impeller, wherein the cover coupler is fixed to the body coupler of the motor housing.

An opened portion, defined by the motor mount and the body coupler of the motor housing spaced apart from each other, may constitute an air discharge opening of the fan motor.

The lower end of the impeller cover may be spaced in a radial direction apart outward from the upper side of the motor mount, and a space between the lower end of the impeller cover and the upper side of the motor mount may constitute the air discharge opening.

The air discharge opening may be opened toward an outer space of the motor mount among inner and outer spaces of the motor mount.

The cover coupler may include a cylindrical shape provided at a lower edge of the impeller cover, the body coupler may include a cylindrical shape corresponding to the cylindrical shape of the cover coupler, and the cover coupler may be coupled to an outer surface of the body coupler.

A cooling flow path inlet that is a passage configured to introduce air for cooling heat generated by the motor part may be provided in at least one of the lateral side or the lower side of the motor mount.

A cooling flow path outlet that is a passage configured to discharge the air having cooled the motor part from the motor mount may be provided at the upper side of the motor mount.

A motor body part may further include a bearing housing disposed at the lower side of the impeller and fixed to the upper side of the motor mount, a bearing support configured to support a shaft of the motor part may be provided at a central portion of the bearing housing, the bearing support and the motor mount may be spaced apart from and fixed to each other, and a space between the bearing support and the motor mount may constitute a part of a passage for discharging air having cooled the motor part from the motor mount.

A fixer mounted onto the upper side of the motor mount may be provided at an edge of the bearing housing, and the fixer and the bearing support may be connected to each other by an inward arm.

The bearing housing may be provided with an outward arm extending outward at a position corresponding to a position in which a connecting arm of the motor mount is provided, and the connecting arm and the outward arm may be coupled to each other.

According to another aspect, a fan motor for a vacuum cleaner may include a motor housing including a motor mount configured to accommodate a motor part; a bearing housing fixed to an upper side of the motor housing; a diffuser fixed to an upper side of the bearing housing with a lower end contacting the bearing housing or the motor mount; an impeller disposed at an upper side of the diffuser and rotated by the motor part; and an impeller cover configured to cover the impeller and the diffuser and installed at the upper side of the motor housing.

A bearing support configured to support a shaft of the motor part may be provided at a central portion of the bearing housing, and a central portion of the diffuser may be coupled near the bearing support of the bearing housing.

A fixer coupled to the upper side of the motor mount may be provided at an edge of the bearing housing. The fixer and the bearing support may be connected to each other by an inward arm and may be spaced apart from each other.

The bearing housing may include a metallic material, and the diffuser may include a synthetic resin.

The diffuser may include a diffuser body, and a vane provided on an outer surface of the diffuser body. A cooling flow path outlet configured to allow air in a lower space of the diffuser body to flow to an upper space of the diffuser body may be provided at a position of the diffuser body, which is closer to the impeller than to the vane.

The bearing housing may include an outward arm extending further outward than the motor mount, and the motor housing may include a connecting arm extending outward near an upper end of the motor mount. The connecting arm and the outward arm may be coupled to each other.

A body coupler configured to fix the impeller cover may be provided at an end of the connecting arm.

A lower edge of the impeller cover may be coupled to the body coupler.

According to another aspect, a fan motor for a vacuum cleaner may include a motor mount configured to accommodate a motor part in the motor mount and including a first cooling flow path inlet, which is a passage for introducing air for cooling heat generated by the motor part, at a lateral side of the motor mount; an impeller placed at an upper side of the motor part and rotated by rotational force received from the motor part; an impeller cover configured to cover the impeller, placed at the upper side of the motor mount, and including an air inlet at an upper central portion of the impeller cover; an air discharge opening opened toward an outer space of the motor mount among inner and outer spaces of the motor mount and configured to discharge air, suctioned through the air inlet and pressurized by the impeller, to the outer space of the motor mount; and a cooling flow path outlet provided at the upper side of the motor mount and configured to communicate the inner space of the motor mount with a space between the impeller and the air discharge opening.

At least part of the air discharged from the air discharge opening may be introduced into the motor mount through the first cooling flow path inlet, and the motor mount may be provided with a guide shape configured to direct a flow of the air introduced into the motor mount through the first cooling flow path inlet toward the motor part.

The cooling flow path outlet may be provided in a radial direction further outward than a side wall member defining the motor mount, the air pressurized by the impeller may be discharged downward through the cooling flow path outlet, and the first cooling flow path inlet may be disposed at a lower side of the cooling flow path outlet.

The motor mount 111 may include a base member having a radius greater than a radius of the side wall member at a lower side of the motor mount, and the guide shape may include a first guide shape that inclines upward further toward radial and outward directions at a portion in which the base member faces the cooling flow path outlet.

The guide shape may further include a second guide shape that is provided in a radial direction further inward than the first guide shape and that inclines upward further toward radial and inward directions.

A second cooling flow path inlet may be provided at a position in a radial direction further inward than the second guide shape such that the second cooling flow path inlet contacts an inner end of the second guide shape in a radial direction.

Air at a lower side of the second cooling flow path inlet may be introduced into the motor mount through the second cooling flow path inlet and may flow upward together with air directed upward by the second guide shape.

The motor mount may include a side wall member configured to accommodate and fix a motor part in radial and inward directions; a plurality of extended arm members extending downward from the side wall member; a first cooling flow path inlet provided among the plurality of extended arm members; and a base member connected to a lower side of the extended arm member.

The extended arm member may include a portion extending downward from the side wall member to the base member in radial and outward directions.

The base member may include the guide shape.

The cooling flow path outlet may be provided at a radial outer side of the side wall member, and at least part of the air discharged from the cooling flow path outlet may flow toward the first cooling flow path inlet.

The motor mount may include a bearing support at a lower central portion of the motor mount, and the bearing support and the base member may be connected by a connecting member.

A second cooling flow path inlet may be provided between adjacent connecting members.

According to another aspect, a fan motor for a vacuum cleaner may include a motor part; a motor mount having an inner space and configured to accommodate the motor part in the inner space; an impeller placed at an upper side of the motor mount and rotated by the motor part; an air discharge opening configured to discharge air pressurized by the impeller to an outer space of the motor mount; a cooling flow path outlet provided in the motor mount and disposed between the impeller and the air discharge opening at the upper side of the motor mount; a first cooling flow path inlet provided in the motor mount and disposed further downward than the air discharge opening and the cooling flow path outlet; and a guide shape configured to direct air introduced to an inner space of the motor mount through the first cooling flow path inlet, out of the air discharged through the air discharge opening, upward in the inner space.

The fan motor may further include a second cooling flow path inlet provided in the motor mount.

One end of the guide shape may be adjacent to the first cooling flow path inlet, and the other end of the guide shape, disposed far from the first cooling flow path inlet, may be adjacent to the second cooling flow path inlet.

One end of the guide shape may be disposed in a radial direction further outward than the other end of the guide shape.

The fan motor may further include an impeller cover configured to cover the impeller, disposed at the upper side of the motor mount, including an air inlet at an upper central portion of the impeller cover, and including the air discharge opening at a lower edge of the impeller cover.

The motor mount includes a base member having a radius greater than a radius of the side wall member at a lower side of the motor mount, and the base member may include the guide shape.

According to another aspect of the subject matter described in this application, a vacuum cleaner may include the fan motor and a housing configured to accommodate the fan motor.

The housing may include an extended guide shape in which the guide shape is extended, and the guide shape and the extended guide shape may be connected in the state in which the fan motor is accommodated in the housing.

The extended guide shape may include a profile that inclines upward further toward radial and outward directions from a rotating shaft of the fan motor.

The housing may include an upper housing configured to regulate and fix the position of an impeller cover of the fan motor, and a lower housing configured to regulate and fix the position of a lower end of the motor mount of the fan motor. The lower housing may include the extended guide shape.

In the housing, an air outlet configured to discharge at least part of air discharged from the air discharge opening may be provided between the air discharge opening and the guide shape in an axial direction of the fan motor, further outward than the guide shape in a radial direction of the fan motor.

The air outlet may be opened in radial and outward directions.

With the fan motor structure of the present disclosure, it may be possible to maximize the power, suction force and suction efficiency of the fan motor by minimizing resistance of the downstream and outlet sides of the air flow generated by the impeller.

In addition, the number and size of components required to form the flow path for air flow can be minimized by arranging the air discharge opening for the suctioned air close to the impeller, thereby making it possible to reduce the size and weight of the product.

In addition, the air flow generated by the fan motor can be discharged to the air atmosphere rather than the motor mount having high flow resistance, without directly using the power of the motor to generate the air flow for cooling of the motor, thereby minimizing the reduction of the power of the fan motor.

In addition, since outer air having a relatively high atmospheric pressure passes through the motor to cool the motor while the air is being introduced into an air flow path of the fan motor having a relatively low pressure, it is possible to cool the motor without adding a separate component or without using the power of the motor.

In addition, some of the kinetic energy generated by a flow of air discharged by the fan motor is used to introduce air for cooling the motor part in the fan motor, thereby smoothly cooling the motor. Further, external air may also be introduced while cooling air is introduced, thereby cooling the motor more smoothly.

In addition, a component supporting the motor part rotating at high speeds in the fan motor and maintaining the entire shape of the fan motor is made of metallic materials with high rigidity, and a component guiding a flow of air is made of a synthetic resin, thereby sufficiently ensuring rigidity of the fan motor rotating at high speeds, ensuring a reduction in weight of the fan motor, and readily forming and manufacturing a component constituting an air flow path.

The above and other effects of the present disclosure will be described below together with examples for carrying out the present disclosure.

DETAILED DESCRIPTION

Figure 1:
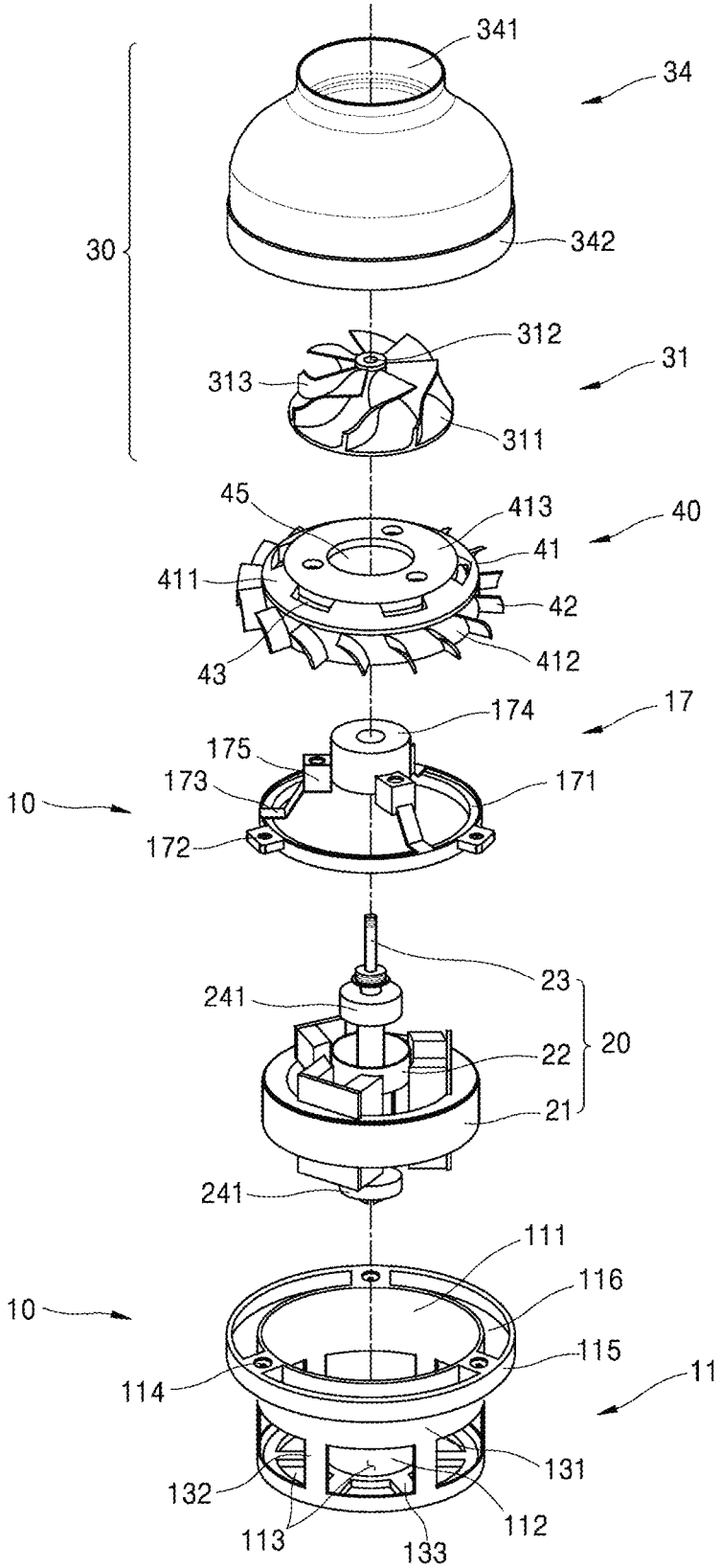
FIG. 1 is an exploded perspective view showing a fan motor according to a first implementation.

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well-known functions or configurations may be omitted in order not to unnecessarily obscure the gist of the present disclosure. Hereinafter, implementations of the present disclosure will be described in detail with reference to the accompanying drawings. Throughout the drawings, like reference numerals refer to like elements.

<Structure of Fan Motor>

Figure 2:
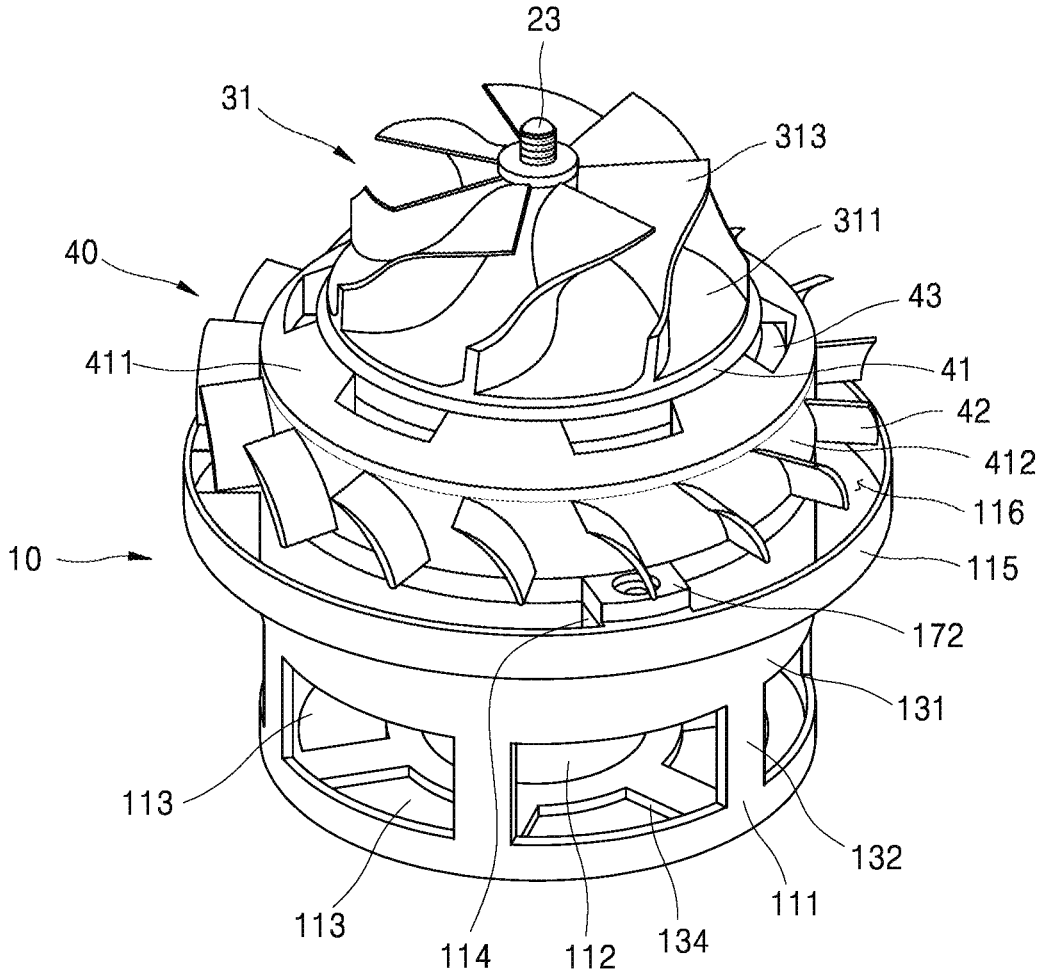
FIG. 2 is a perspective view showing the fan motor according to the first implementation without an impeller cover.
Figure 3:
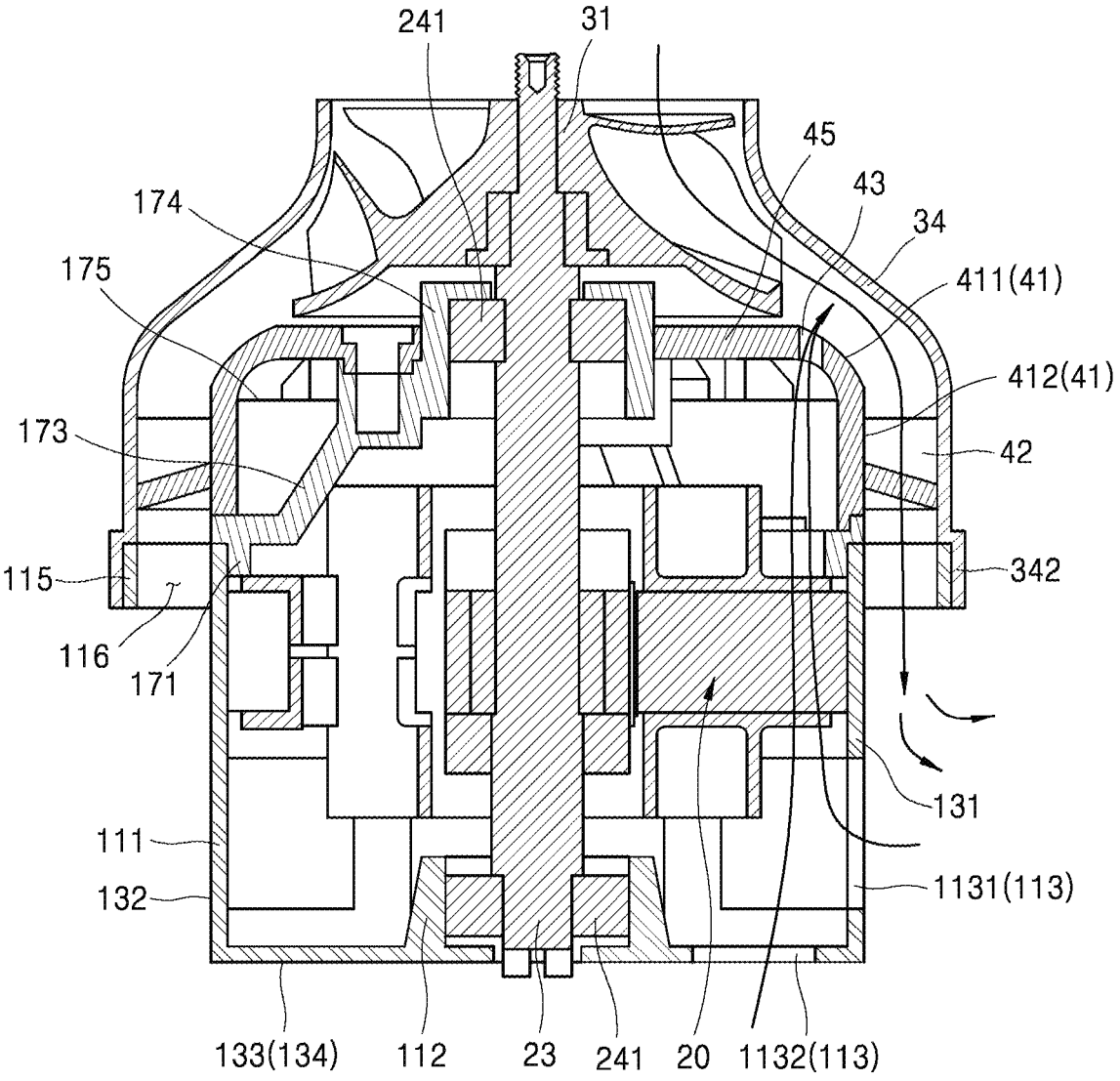
FIG. 3 is a side cross-sectional view showing the fan motor according to the first implementation.

According to a first implementation of the present disclosure, which is illustrated in FIGS. 1 to 3, a fan motor includes a motor part 20, a motor body part 10 which accommodates and supports the motor part 20 and forms the entire frame of the fan motor, a flow generating part 30 which is installed above the motor body part 10 of the motor fan and generates an air flow, and a diffuser 40 which disperses the air flow generated in the flow generating part 30.

<Motor Part>

The motor part 20 includes an annular stator 21, a shaft 23 passing through the center of the stator 21, and a rotor 22 which is axially formed on the shaft 23 and generates a torque in conjunction with the stator 21. In this implementation, the motor part 20 is exemplified with a brushless direct current (BLDC) motor. Although it is illustrated in this implementation that the stator 21 is disposed outside the rotor 22 as the BLDC motor, the stator 21 may be disposed inside the rotor 22 unless contradictory.

The shaft 23 is rotatably supported by bearings 241. In this implementation, an example support structure includes a pair of bearings 241 respectively installed at both ends of the shaft 23 with the rotor 22 interposed between the pair of bearings 241. In some examples, a support structure for supporting the bearings 241 may be installed on one side of the shaft 23, for example, on the upper side of the rotor 22. In some examples, one bearing 241 may be installed on the lower side of the shaft 23 and be fixedly supported by a motor housing 11, and the other bearing 241 may be installed on the upper side of the shaft 23 and be supported by a bearing housing 17.

<Motor Body Part>

The motor body part 10 may include a motor housing 11 that accommodates the motor part 20 and that includes a body coupler 115 configured to couple to an impeller cover 34, and a bearing housing 17 that couples to the upper side of the motor housing 11 and that supports the bearings 241 installed on the upper side of the motor part 20.

As will be described later, the motor body part 10 including the motor housing 11 and bearing housing 17 is made of a metallic material with high rigidity to firmly support a shat of the motor part 20 and to firmly support the impeller cover guiding air that flows at high speeds.

<Motor Housing>

The motor housing 11 may include a cylindrical motor mount 111 in which the motor part 20 is mounted, with its upper side opened, connecting arms 114 radially extending outward from the upper end of the motor mount 111, and an annular body coupler 115 provided at the end portions of the connecting arms 114 and having a diameter larger than the diameter of the motor mount 111.

The motor mount 111 may include a side wall member 131 defining a lateral surface of a cylinder, and a base member 133 provided at a lower end of the side wall member 131 and defining the bottom of the motor mount 111. A first bearing support 112 for fixing and supporting the bearing 241 on the lower side of the motor part 20 may be provided at a central portion of the bottom of the motor mount 111, i.e., the base member 133. The first bearing support 112 has a cylindrical shape with its upper side opened and the bearing 241 on the lower side of the shaft 23 is inserted into and supported by the first bearing support 112 through the opened upper side of the first bearing support 112.

A cooling flow path inlet 113 through which air for cooling the motor part 20 flows may be provided around the first bearing support 112 at the bottom of the motor mount 111, i.e., at the base member 133. The cooling flow path inlet 113 may be provided not only at the bottom of the motor mount 111 but also on the lower side of the side wall member 131 of the motor mount 111. A first cooling flow path inlet 1131 provided on the side wall member 131, and a second cooling flow path inlet 1132 provided on the base member 133 serves as a passage through which air flows from the outside of the fan motor into the motor mount 111.

The second cooling flow path inlet 1132 introduces air outside the fan motor into the motor mount 111 or discharges air in the motor mount 111 out of the fan motor, on the basis of a flow of cooling air. Even though the second cooling flow path inlet 1132 is referred to as an "inlet", the flow of air may be changed depending on how the flow of air, caused by the impeller 31 of the fan motor, is controlled after the air is discharged through a cooling flow path outlet 43.

The second cooling flow path inlet 1132 may be arranged radially on the base member 133 as shown in the figure, and a plurality of first cooling flow path inlets 1131 may also be arranged at regular intervals along the circumferential direction of the side wall member 131. Accordingly, a connecting member 134 extending radially is provided between adjacent second cooling flow path inlets 1132, and an extended arm member 132 extending in the up-down direction is provided between adjacent first cooling flow path inlets 1131. For example, the plurality of cooling flow path inlets 113 may be arranged about an axis of the motor mount 111 at an angular interval. These cooling flow path inlets 113 may be arranged in various arrangements and shapes as long as the rigidity of the first bearing support 112 and the rigidity of the entire motor mount 111 can be maintained.

In examples where the side wall member 131 of the motor mount 111 supports the stator 21 embedded in the motor mount 111, it may be preferable to provide the first cooling flow path inlet 1131 in the side wall member below a support portion of the stator 21.

As will be described later in connection with the air flow path and the motor part cooling path applied to the fan motor of this implementation, since an air discharge opening 116 of the fan motor of this implementation is located at an upper side of the motor mount 111, it may be preferable to provide the first cooling flow path inlet 1131 on the side wall member 131 of the motor mount 111 at a position slightly distanced from the air discharge opening 116 so as to communicate to a space as close as possible to the atmospheric pressure.

In this implementation, the cooling flow path inlet 113 may function as a passage through which the air for cooling the motor part 20 flows into the motor mount 111, while reducing the weight of the fan motor.

The side wall member 131 of the motor mount 111 has a substantially cylindrical shape and the stator 21 may be fixed to an inner surface of the side wall.

The upper end portion of the side wall member 131 of the motor mount 111 includes the connecting arms 114 extending radially from the side wall member 131, and the body coupler 115 provided at the outer end of the connecting arms 114 in the radial direction. A space defined by the upper end portion of the side wall member 131 of the motor mount 111 and the inner surface of the body coupler 115 may serve as the air discharge opening 116 through which an air flow generated by an impeller 31 is discharged.

According to the present disclosure, the air discharge opening 116 is provided at an upper edge of the motor housing 11, and air discharged through the air discharge opening 116 is immediately discharged to an outer space, not to an inner space the motor mount 111. Thus, the air causes flow resistance no longer.

The upper end portion of the motor mount 111 may provide a surface on which the bearing housing 17 is seated, and the connecting arms 114 provide a coupling portion to which an outward arm 172 of the bearing housing is fixed. Further, the connecting arms 114 each may define a screw fastening hole into which the outward arm 172 can be screwed with a screw.

The number and thickness of connecting arms 114 may be appropriately selected in order to secure the flow sectional area of the air discharge opening 116 and to secure a force of coupling with the bearing housing. For example, this implementation provides a structure in which three connecting arms 114 are provided at intervals of 120 degrees.

The body coupler 115 may have a ring shape with a larger diameter than the motor mount 111. As an example of the shape of the body coupler 115, the body coupler 115 may have a cylindrical shape having a low height as shown in the figure. As another example, the body coupler 115 may have a structure similar to a flat flange. However, having the body coupler 115 in a cylindrical shape with a low height as shown in the figure can further reduce the diameter of the fan motor as a whole, which is more advantageous for miniaturization.

As shown in FIG. 3, the body coupler 115 may be coupled around the lower end of the impeller cover 34.

<Bearing Housing>

The bearing housing 17 may be installed above the motor housing 11 in a state where the motor part 20 is accommodated in the motor housing 11. The bearing housing 17 provides a structure that supports the bearing 241 provided on the upper side of the motor part 20. In this example, the lower end of the shaft 23 is supported by the motor housing 11 and the upper end of the shaft 23 is supported by the bearing housing 17 with the rotor 22 located between the lower and upper ends of the shaft 23.

Since the motor housing 11 and the bearing housing 17 support the rotor 22 and the shaft 23 that rotate at a high speed, the motor housing 11 and the bearing housing 17 may be made of a metal material having high rigidity.

In some examples, the motor housing 11 and the bearing housing 17 have a structure that precisely aligns and reliably supports the rotating shaft of the motor part rotating at a high speed. Therefore, the motor housing 11 and the bearing housing 17 are structured such that their positions are precisely regulated and fastened.

The bearing housing 17 may include a second bearing support 174 at the center thereof for supporting the bearing 241 provided at the upper end of the shaft 23. The second bearing support 174 may have a hollow cylindrical shape with its lower side opened and its upper central portion defining a hole through which the shaft passes. The bearing 241 may be inserted into the second bearing support 174 from below.

A plurality of inward arms 173 may be arranged radially around the outer periphery of the second bearing support 174. In this example, as shown in FIG. 1, three inward arms are arranged at regular intervals of 120 degrees. The inward arms 173 extend outward from the second bearing support 174.

In some examples, a rectangular parallelepiped fastener 175 that is thicker than the inward arms may be provided at a portion connecting the inside of the inward arms 173 to the second bearing support 174 in the radial direction. The fastener 175 is a portion where the central portion of the diffuser 40 is seated and fixed, and the fastener 175 defines a screw fastening hole for coupling the fastener 175 to the diffuser.

As will be described later, a flow path for allowing air suctioned by the impeller to flow is provided at an upper side of the bearing housing 17. Accordingly, a forming part is required for guiding a flow of air at the upper side of the bearing housing 17. According to the present disclosure, a diffuser 40 made of a synthetic resin that is useful to reduce the weight of s fan motor and to form a streamlined shape required for a flow of air is provided as a component in addition to the bearing housing 17.

The inward arms 173 are applied in the form of an arm to regulate the position of the second bearing support 174 exactly and firmly, to support a shaft of the motor part that rotates at high speeds, and to reduce the weight of the fan motor. As will be described later, a space ensured by the inward arms 173 serves as a path for air for cooling the motor part.

An annular fixer 171 fixed to the upper end of the side wall of the motor mount 111 is provided outside the inward arms 173 in the radial direction. The lower side of the fixer 171 engages with the upper side of the motor mount 111. For example, a step is formed in the lower side of the fixer 171 and engages with the upper surface and the upper inner surface of the motor mount 111. This engaging structure precisely regulates the axial and radial positions of the bearing housing 17 relative to the motor housing 11. In addition, since the step of the fixer 171 is formed toward the inner diameter side of the motor mount 111 so that the sectional area of the air discharge opening 116 located on the outer diameter side of the motor mount can be further secured.

The outward arm 172 extending radially outward is provided in the outer circumferential surface of the fixer 171. The outward arm 172 also has a screw fastening hole. The arrangement of the outward arm 172 and the screw fastening hole provided therein matches with the arrangement of the connecting arms 114 of the motor housing 11 and the screw fastening hole provided therein.

In a state where the outward arm 172 and the connecting arms 114 are aligned with each other and the fixer 171 is fitted to the upper end of the motor mount 111, when the outward arm 172 and the connecting arms 114 are screwed by a screw, the motor housing 11 and the bearing housing 17 are firmly fixed in a precisely aligned state.

The bearing housing 17 may be made of a metal material to ensure sufficient rigidity. In addition, the second bearing support 174 and the fixer 171 of the bearing housing 17 are arranged to be spaced apart from each other through the inward arm 173. This arrangement contributes to reducing the weight of the bearing housing 17. As will be described later, a space formed by the second bearing support 174 and the fixer 171 being separated from each other provides a path through which air which flows into the motor mount 111 through the cooling flow path inlet 113 and cools the motor part 20 can escape upward from the motor mount 111.

<Diffuser>

The diffuser 40 may be installed on the upper side of the bearing housing 17. The diffuser 40 includes a diffuser body 41 defining the overall appearance of the diffuser and vanes 42 provided on the outer surface of the diffuser body 41.

The diffuser body 41 includes a flat portion 413 having a hole 45 formed in its central portion, an inclined portion 411 inclined outwardly from the outer edge of the flat portion 413 in the radial direction, and a cylindrical portion 412 extending downward from the outer edge of the inclined portion 411.

The impeller 31 is disposed above the flat portion 413 and the lower surface of the flat portion 413 is placed on the fastener 175. The hole 45 of the flat portion 413 is formed in a shape engaging with the outer circumferential surface of the second bearing support 174 and a screw fastening hole is formed in the flat portion 413 around the hole 45 at a position corresponding to the screw fastening hole of the fastener 175. In one implementation, the hole 45 may have a circular shape with its diameter corresponding to the diameter of the second cylindrical bearing support 174. In this example, the inner circumferential surface of the hole 45 engages with the outer circumferential surface of the second bearing support 174. In this state, the flat portion and the fastener are fixed to each other by a screw through the screw fastening hole.

The inclined portion 411 is formed at the outer edge of the flat portion 413. The inclination angle of the inclined portion 411 may correspond to the inclination angle of the impeller 31. That is, in this implementation, the impeller 31 and the diffuser 40 may be of a diagonal-flow type.

For example, the outer diameter of the cylindrical portion 412 may correspond to the outer diameter of the side wall of the motor mount 111. The lower end of the cylindrical portion 412 may be in direct or indirect close contact with the upper end of the motor mount 111. In this example, with the fixer 171 of the bearing housing 17 interposed between the motor mount 111 and the cylindrical portion 412, the lower end of the cylindrical portion 412 and the upper end of the motor mount 111 are in close contact.

In some examples, a stepped structure may be formed on the upper side of the fixer 171 of the bearing housing 17. For example, the stepped structure corresponding to the stepped structure of the fixer 171 may be formed on the lower end of the cylindrical portion 412 of the diffuser 40.

Air pressurized by the impeller 31 may flow along the outer surface of the diffuser body 41 and may be discharged to the outside through the air discharge opening 116. For example, the diffuser body 41 together with the impeller cover 34 may guide the air pressurized by the impeller 31 to the air discharge opening 116.

In order to prevent a flow of air generated by the impeller from flowing into the motor mount 111, the diffuser 40 and the motor body part 10 may be in close contact with each other. In this regard, as described above, the hole 45 and the second bearing support 174 have the engaging structure, the lower end of the cylindrical portion 412 and the upper side of the fixer 171 have a step engaging structure, and the lower side of the fixer 171 and the upper side of the motor mount 111 have the step engaging structure.

The vanes 42 are provided in the lower end of the diffuser 40. The vanes 42 may guide the flow of the air pressurized and moved by the impeller 31 toward the air discharge opening 116. In this implementation, the air discharge opening 116 is defined in the upper side of the motor housing 11 and the vanes 42 are provided in the diffuser 40 above the air discharge opening 116.

In this implementation, the bearing housing 17 described above may be made of a metal material, and the diffuser 40 may be made of a synthetic resin material. The bearing housing 17 may be made of a metal material in order to secure rigidity to support the motor portion rotating at a high speed. On the other hand, in order to facilitate machining of the vanes 42 that may have a complicated shape but may not require a high rigidity because the vanes 42 function to guide the flow of air pressurized by the impeller 31, the diffuser 40 may be made of a synthetic resin material.

If the bearing housing 17 and the diffuser 40 are integrally formed, chances are that the material thereof is a metal in order to secure the support rigidity to the motor part. However, this will cause limitations in the method of machining the vanes 42 and in reducing weight of a fan motor In this implementation, the bearing housing 17 and the diffuser 40 are separately made of different materials from each other according to the respective desired conditions, which may make it possible to easily machine them and reduce the weight of the product.

In this implementation, since the air discharge opening 116 is disposed on the upper side of the motor housing 11, the vanes 42 can be disposed above the motor housing 11. Therefore, it is possible to form the vanes 42 in the diffuser 40 made of synthetic resin rather in the motor housing 11 made of metal, which contributes to reducing the overall size and weight of the product as well as to simplifying the manufacturing of the product The diffuser 40 is located below the impeller 31 and above the bearing housing 17 when viewed in the vertical direction and is located outside the impeller 31 and inside the body coupler 115 when viewed in the radial direction.

In some examples, a plurality of cooling flow path outlets 43 are provided along the circumference of the inclined portion 411 of the diffuser 40. The cooling flow path outlets 43 may form a passage communicating between the upper space of the diffuser body 41 and the lower space of the diffuser body 41.

The lower space of the diffuser body 41 is a motor accommodation space defined by the bottom of the diffuser body 41 and the motor mount 111. The cooling flow path inlet 113 is provided at the bottom and the lower side of the side wall of the motor mount 111 and is opened toward a space of the air atmosphere.

Since the upper space of the diffuser body 41 is a space in which the air pressurized by the impeller 31 flows rapidly, the pressure of the upper space of the diffuser body 41 is relatively lower than the internal pressure of the motor mount 111. Due to such a pressure difference, air in the motor mount 111 flows into the upper space of the diffuser body 41 through the cooling flow path outlets 43 and then the internal space of the motor mount 111 is filled with air introduced from the cooling flow path inlet 113.

The cooling flow path outlets 43 are provided at a position closer to the impeller 31 than the vanes 42. In addition, since the cooling flow path outlets 43 are disposed close to the air discharge side of the impeller 31, a pressure difference between the upper and lower sides of the cooling flow path outlets 43 is further increased so that air for cooling the motor part 20 flows smoothly.

<Impeller>

The impeller 31 may be installed on the upper side of the diffuser 40. A shaft hole 312 through which the shaft 23 is inserted in the vertical direction may be defined at the center of the impeller 31. The shaft hole 312 may be formed in a hub or the impeller body 311 that supports the overall rigidity of the impeller 31 so that the torque of the shaft 23 can be well transferred to the impeller 31.

The impeller body 311 may include an inclined surface that is inclined downward in the radial direction from the rotational center. That is, in this implementation, the impeller 31 may be a diagonal-flow type or a mixed-flow type impeller. A plurality of blades 313 for pressing air are provided radially on the upper side of the impeller body 311.

In order to increase the suction efficiency of the impeller 31, it may be preferable that the upper end of the blades 311 has little gap with the inner surface of the impeller cover 34 which will be described below.

<Impeller Cover>

The impeller cover 34 covers the upper side of the motor body part 10. An air inlet 341 which is a passage through which air is suctioned into the fan motor is formed in the upper central side of the impeller cover 34.

The impeller cover 34 is inclined downward from the air inlet 341 as the distance from the central axis of the fan motor increases, and a cover coupler 342 is provided at the lower end of the impeller cover 34.

The cover coupler 342 has a structure that engages with the body coupler 115 of the motor body part 10. The body coupler 115 is fitted into a step of the cover coupler 342.

The impeller cover 34 among the components of the fan motor does not directly support the motor part 20. Accordingly, the impeller cover may be made of a lightweight synthetic resin. However, a lower end of the impeller cover is fixed and supported by the metal-based motor housing 11. Thus, the position of the impeller cover may be firmly maintained.

<Flow Path of Suctioned Air>

The fan motor having the above-described structure may suction air through the air inlet 341 provided at the upper central side of the impeller cover 34, and may discharge air through a space formed between the lower end of the impeller cover 34 and the motor mount 111, for example, through the air discharge opening 116 defined around the upper side of the motor housing 11.

The suctioned air may be pressurized by the impeller 31 and flows. The air at the output side of the impeller 31 may reach the air discharge opening 116 through an air flow path defined by the inner surface of the impeller cover 34 and the outer surface of the diffuser 40.

The impeller 31, the diffuser 40, and the impeller cover 34 are of a mixed-flow type in order to minimize the flow resistance loss of the suctioned air. In addition, the outer surfaces of diffuser body 41, the fixer 171, and the side wall of the motor mount 111 are smoothly connected to each other to minimize an air flow loss. Similarly, the inner surface of the lower end of the impeller cover 34 and the inner surface of the body coupler 115 are smoothly connected to minimize the air flow loss.

The flow of air that is expanded and decelerated through the inclined portion 411 of the diffuser 40 is redirected by the vanes 42 and discharged downward with respect to the section of the air discharge opening 116.

In this implementation, since the air discharge opening 116 is provided on the upper side of the motor housing 11, a path of flow of the suctioned air can be reduced, which leads to reduction in a flow loss. Additionally, the path of flow of the suctioned air may be shortened, which leads to a reduction in the number and size of components having a shape for guiding a flow of the suctioned air and a reduction in the weight of the product. Further, since the diameter of the motor housing 11 can be reduced, it is possible to further downsize the fan motor. That is, a diameter of the motor mount 111 is a diameter of the fan motor in the rest portion of the motor housing 11 except the upper end thereof. Accordingly, it is possible to further downsize the fan motor.

Furthermore, the vane 42 is provided to the diffuser 40 made of a lightweight synthetic resin, thereby simplifying the manufacturing of the fan motor and reducing the weight of the fan motor.

<Flow Path of Cooling Air>

The fan motor can rotate at an extremely high speed. In order to increase the power of the fan motor, for example, by rotating the fan motor up to about 100,000 rpm, the amount of heat generated by the motor part 20 may further increase.

A coil wound on the motor part is usually coated with enamel. If the enamel coating is melted and peeled off due to poor cooling of the motor part, the motor part is broken. In addition, when the motor part is raised to a high temperature, it affects a magnetic field, which may cause a decrease in power. Therefore, a proper cooling of the motor part is an essential factor in motor design.

In some examples where a separate cooling fan for making a flow of cooling air is provided at the lower end of the shaft 23 in order to cool the motor part 20, operating the separate cooling fan may lead to a power loss of the fan motor. That is, a method of using some of the power of the fan motor to make a cooling air flow in order to cool the heat generated in the motor part does not match the purpose of increasing speed of the fan motor. In some cases, providing a separate fan for cooling may adversely affect the downsizing of the fan motor.

In some cases, a conventional cooling structure for the suctioned air to pass through an internal space of the motor mount 111, where the motor part 20 is installed, to cool the motor part 20 may cause even higher flow loss and resistance of the downstream side of air flow than the impeller 31, which decreases the power of the fan motor.

In contrast, according to the implementation of the present disclosure, the reduction of power generated to cool the motor part is minimized by causing air to flow naturally due to a pressure difference and allowing the air to flow through a space where the motor part 20 is installed.

In the flow path of the suctioned air, the cooling flow path outlets 43 formed in the inclined portion 411 of the diffuser 40 makes a space serving as a flow path of the suctioned air to communicate with a space in which the motor part 20 is installed. The air pressurized by the impeller 31 has a very high flow velocity in the upper space of the diffuser 40 so that the pressure in the upper space of the diffuser 40 is lower than the space in which the motor part 20 is installed. This allows air to flow along a path ranging from the outside of the motor housing 11 under the atmospheric pressure, through the cooling flow path inlet 113, the space in which the motor part 20 is installed, and the space between the bearing support 174 and fixer 171 of the bearing housing 17, to the cooling flow path outlets 43.

The flow of air generated in this manner may increase with an increase in the rotational speed of the fan motor.

In some examples, the power of the fan motor may decrease even when the flow of air for cooling the motor part is induced. For example, there may be a slight power loss in flowing through the cooling flow path described above. However, it may be possible to minimize the degree of deterioration of the efficiency of the fan motor as compared with a forced flow method by a separate cooling fan or a method of passing the suctioned air through the installation space of the motor part 20. In addition, it may be possible to cool the motor part smoothly while minimizing the deterioration of the efficiency of the fan motor.

In this implementation, the cooling flow path inlet 113 that introduces air for cooling the motor part 20 is formed. Accordingly, the weight of the motor housing 11 may be reduced, and an additional fan for generating a flow of cooling air may not be required. Additionally, a flow loss of air generated by the impeller may be minimized and the motor part may be downsized. Thus, the structure of the present disclosure is advantageous in reducing the size and weight of a fan motor.

Figure 4:
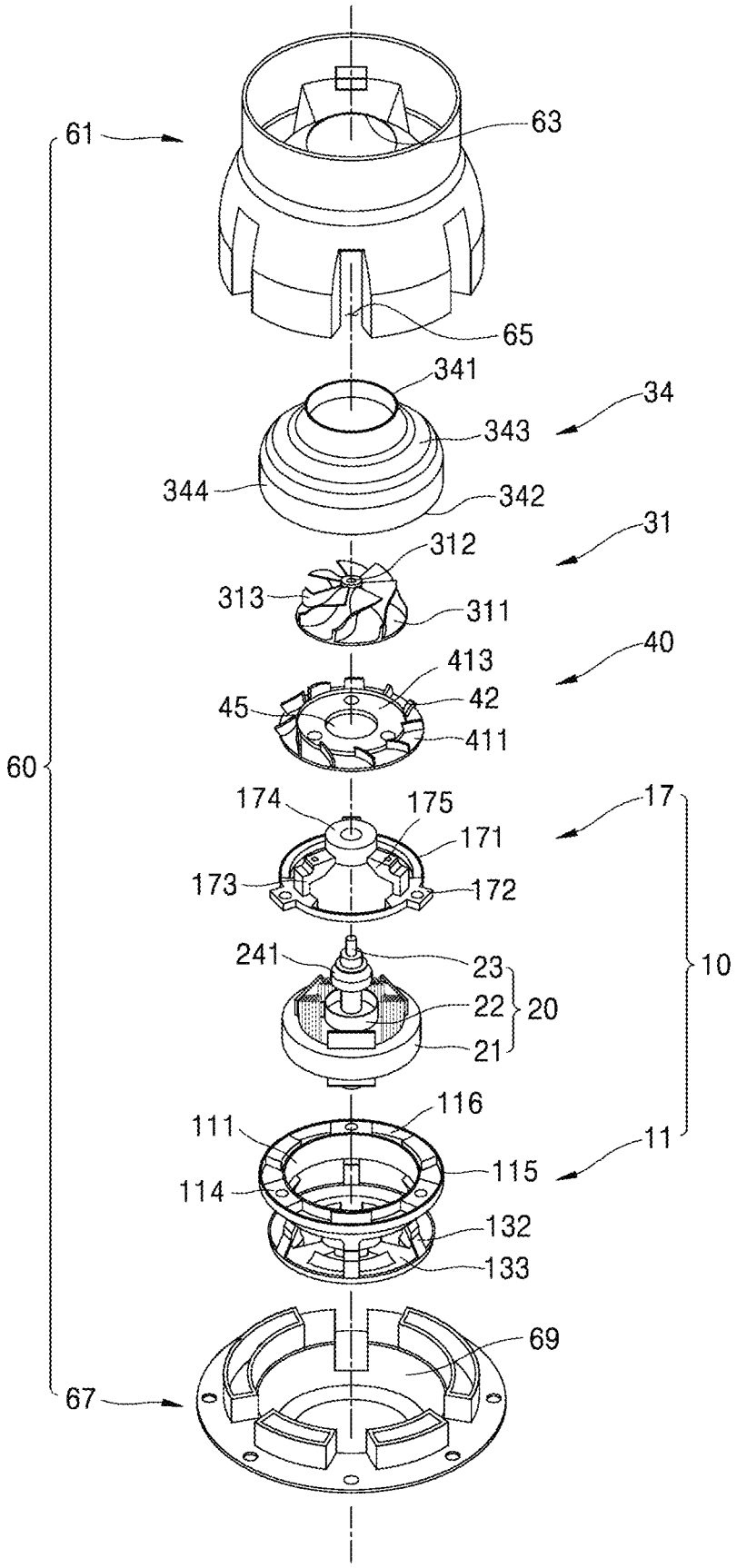
FIG. 4 is an exploded perspective view showing a fan motor and a housing according to a second embodiment.
Figure 5:
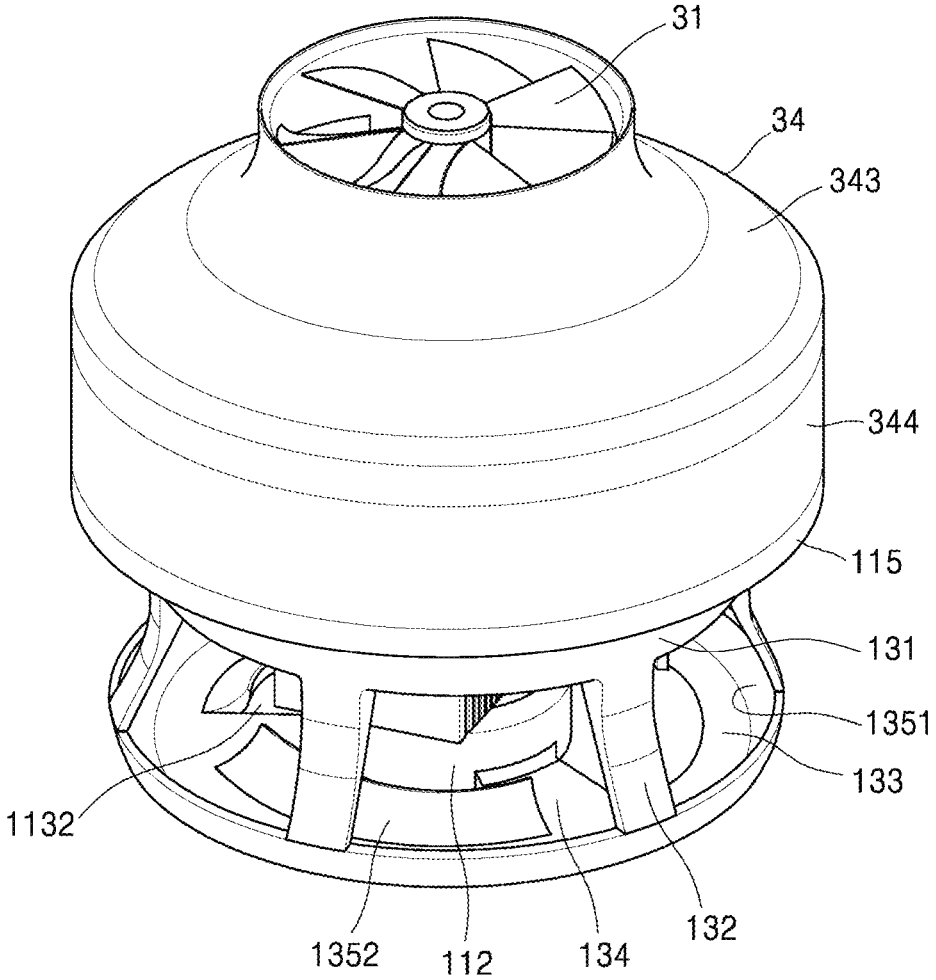
FIG. 5 is a perspective view showing the fan motor in FIG. 4.
Figure 6:
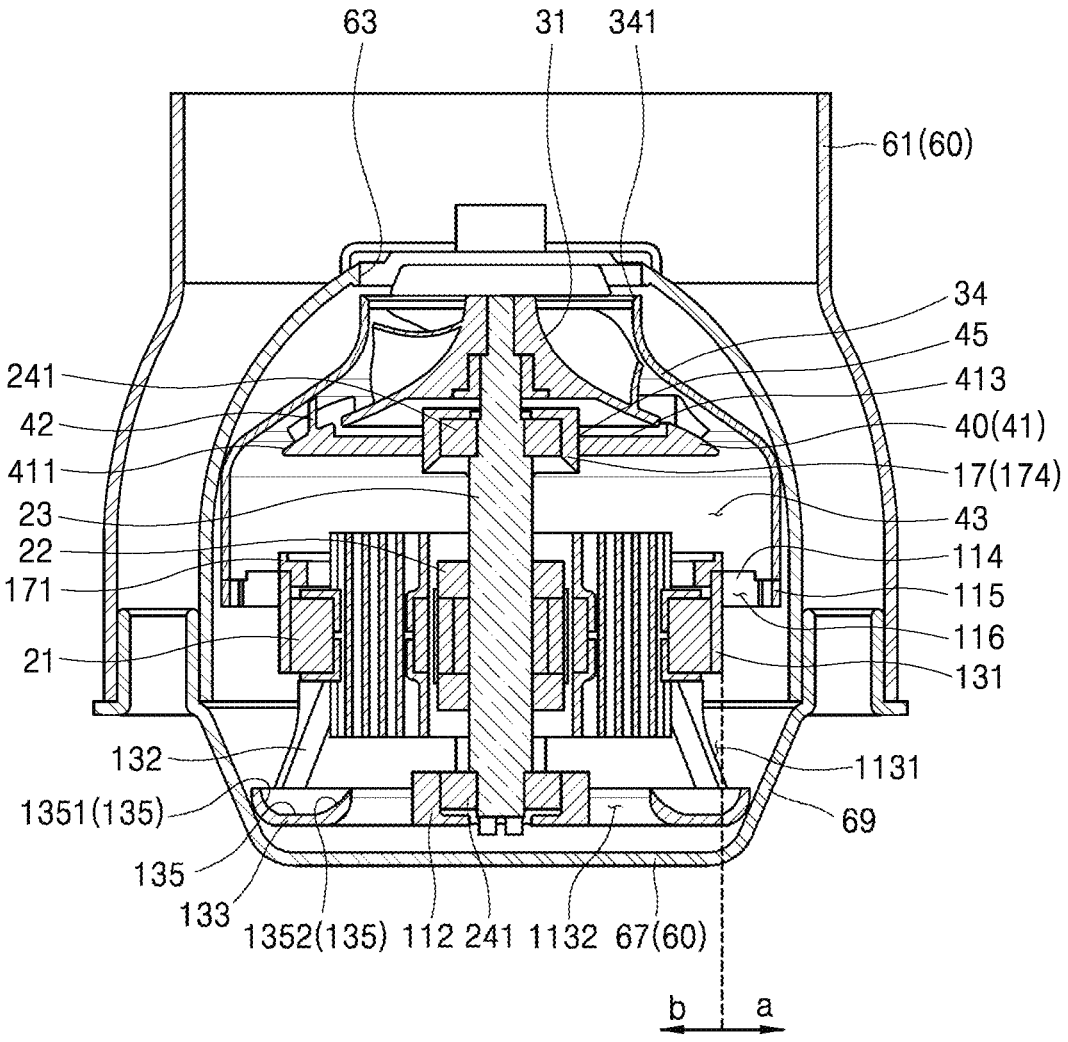
FIG. 6 is a side cross-sectional view showing the fan motor according to the second implementation, installed in a housing of a vacuum cleaner.
Figure 7:
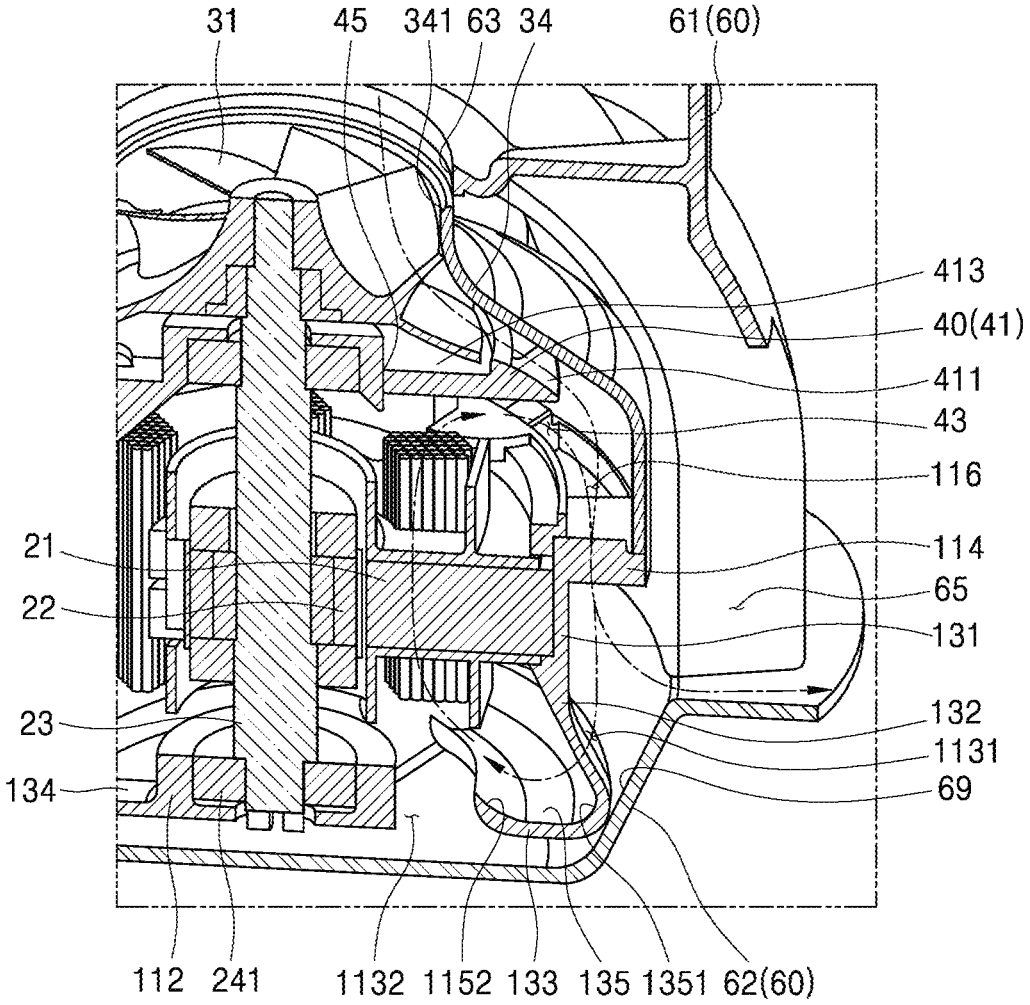
FIG. 7 is a perspective view showing an enlarged portion of the fan motor and the housing in FIG. 6.
Figure 8:
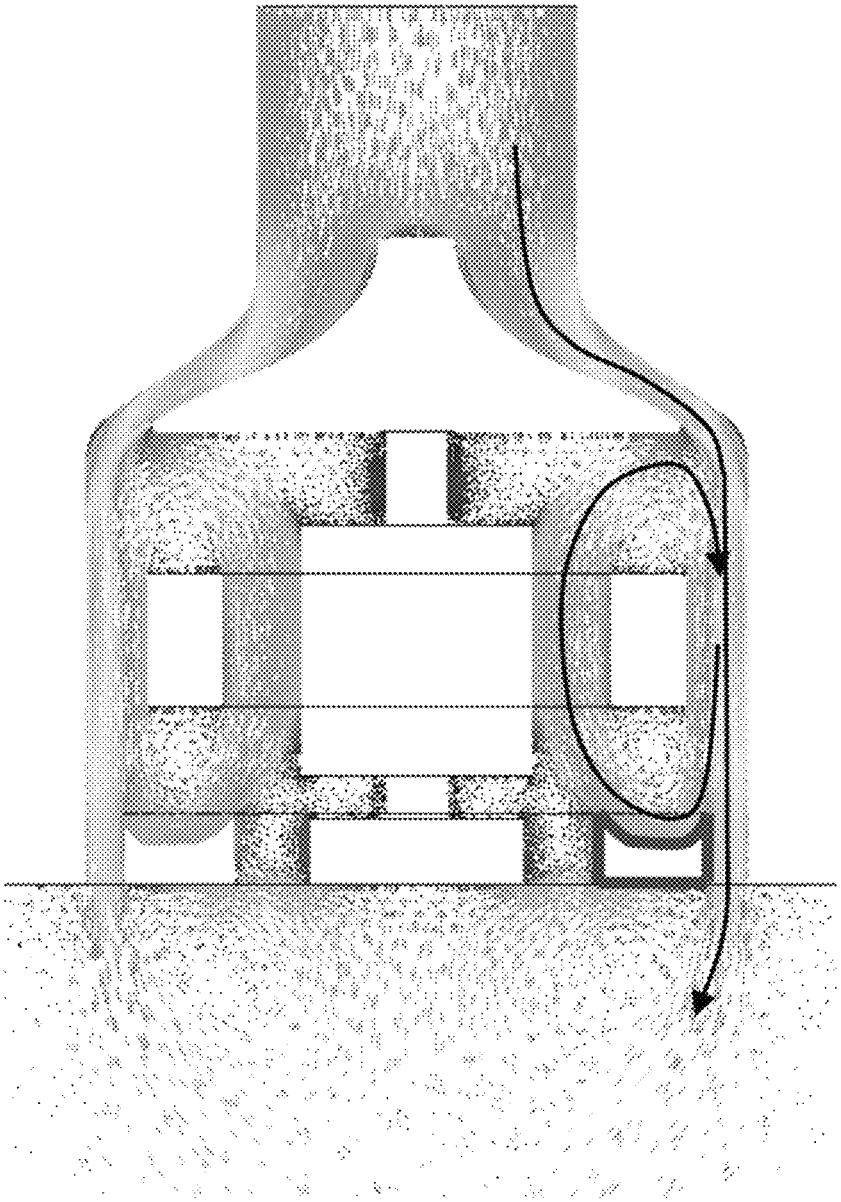
FIG. 8 is a view showing a flow (movements) of the fan motor according to the second implementation.

Below, a second implementation that is a modified example of the first implementation is described with reference to FIGS. 4 to 6. During description of the second implementation, what has been described with reference to the first implementation will be omitted. It should be apparent that the configurations of the first implementation and the second implementation may be mutually replaced, modified, added and removed.

<Motor Housing>

In the second implementation, the motor housing 11 may include a hollow container-shaped motor mount 111 in which the motor part 20 is embedded with its upper side opened, connecting arms 114 radially extending outward from an upper end of the motor mount 111 in a radial direction, and an annular body coupler 115 provided at an end portion of the connecting arm 114 and having a diameter greater than a diameter of the motor mount 111. A ring-shaped opened portion between the motor mount 111 and the body coupler 115 defines the air discharge opening 116 of the fan motor.

The motor mount 111 may include a side wall member 131 defining a lateral surface of a cylinder, and a base member 133 provided at a lower end of the side wall member 131 and defining the bottom of the motor mount 111. In the second implementation, the motor mount 111 has a structure in which a diameter of the base member 133 is greater than a diameter of the side wall member 131. That is, the upper side of the side wall member 131 may have a cylindrical shape, and a diameter of an extended arm member 132 at the lower side of the side wall member 131 may become greater further downward like a truncated cone. The side wall member 131, the extended arm member 132, and the base member 133 may have a shape similar to the shape of a conical flask, as a whole.

However, a first boundary between the cylindrical upper side of the motor mount 111 and the lower side, having an extended diameter, of the motor mount 111 may not be matched with a second boundary between the side wall member 131 and the extended arm member 132. That is, the second boundary may be positioned further upward than the first boundary, and the second boundary may be positioned further downward than the first boundary. Like the second implementation, the extended arm member 132 may be provided with both the cylindrical section and the section having an extended diameter. Additionally, unlike the second implementation, the side wall member 131 may be provided with both the cylindrical section and the section having an extended diameter. This relates to a surface area and arrangement of a below-described first cooling flow path inlet 1131.

A first bearing support 112 may be provided at a central portion of the base member 133. A second cooling flow path inlet 1132 for introducing air for cooling the motor part 20 may be provided on the base member 133 around the first bearing support 112 on the base member 130. A first cooling flow path inlet 1131 may be provided on a lower side of the side wall member 131 of the motor mount 111. The first cooling flow path inlet 1131 may be provided in a section in which a diameter of the motor mount 111 is extended. Additionally, the first cooling flow path inlet 1131, as in the second implementation, may extend to the cylindrical section adjacent to the diameter-extended section as well as the diameter-extended section.

At least part of the first cooling flow path inlet 1131 faces the air discharge opening 116 obliquely at a lower side of the air discharge opening 116 that is defined as a space between the cylindrical side wall member 131 and the body coupler 115. Air discharged from the air discharge opening 116 strongly flows downward. Accordingly, at least part of the discharged air may be directly introduced to the inner space of the motor mount 111 through the first cooling flow path inlet 1131.

The extended arm member 132 is connected upward with the side wall member 131, and is connected downward with the base member 133. A diameter of the base member 133 is greater than that of the side wall member 131 with respect to the rotating shaft (ref. 23). Accordingly, an outer edge of the base member 133 in a radial direction thereof may directly face air that moves downward through the air discharge opening 116.

A lower end of the extended arm member 132 may be connected to the radial outer edge of the base member 133. Accordingly, air discharged from the air discharge opening 116 may pass through the extended arm members 132, and the first cooling flow path inlet 1131 that is defined as an opened portion between the extended arm members 132, and then may reach the base member 133.

A diameter of the base member 133 may be greater than or less than a diameter of the body coupler 115. In the second implementation, the base member 133 has a diameter less than that of the body coupler 115.

The base member 133 may be provided with a guide shape 135 that directs air, flowing downward through the air discharge opening 116, toward the motor part 20 in the motor mount 111. The guide shape 135 may include a first guide shape 1351 that directs air, flowing downward, in radial and inward directions, and a second guide shape 1352 that directs air, flowing in radial and inward directions, upward again.

The first guide shape 1351 may be provided in an area (a; ref. FIG. 5) of the base member 133, which has a diameter greater than a diameter of the cylindrical section of the side wall member 131. The first guide shape 1351 may include an inclined surface that inclines upward further toward radial and outward directions. A cross section of the inclined surface may have a streamlined profile that is convex downward.

The second guide shape 1352 may be provided in an area (b; ref. FIG. 5) of the base member 133, which has a diameter less than a diameter of the cylindrical section of the side wall member 131. The second guide shape 1352 may include an inclined surface that inclines upward further toward radial and outward directions. A cross section of the inclined surface may have a streamlined profile that is convex downward.

A section, which guides the air directed by the first guide shape 1351 such that a flow of the directed air may be a laminar flow, may be provided between the first guide shape 1351 and the second guide shape 1352 in a radial direction. The section may include a flat surface.

At least part of air discharged downward from the air discharge opening 116 is introduced into the motor mount 111 through the first cooling flow path inlet 1131, is directed in radial and inward directions by the first guide shape 1351, and then is directed upward again by the second guide shape 1352. Thus, the motor part 20 may be cooled.

A lower end of the extended arm member 132 is connected to the radial outer edge of the base member 133. Accordingly, air discharged from the air discharge opening 116 may first pass through the extended arm member 132 and then may reach the first guide shape 1351. A flow of air that has become turbulence partially while passing through the extended arm member 132 may be stabilized through the guide shape 135.

The second cooling flow path inlet 1132 is provided near a radial inner edge of the second guide shape 1352 inside the second guide shape 1352 in the radial direction thereof. A connecting member 134 connecting the first bearing support 112 of the base member 133 and a portion of the guide shape 135 may be provided between the second cooling flow path inlets 1132. A portion in which the connecting member 134 is placed may not include the second guide shape 1352.

As an example, the second guide shape 1352 may be manufactured by cutting the base member 133 in the form of "∏" and by press-forming the cut "∏" portion in the way that the cut "∏" portion is lifted upward. An opened portion that is formed by lifting the cut portion may constitute the second cooling flow path inlet 1132.

A meridian angle of the extended arm member 132 may be matched with a meridian angle of the connecting member 134 with respect to the rotating shaft. That is, the connecting member 134 and the extended arm member 132 may be arranged at the same angle with respect to the rotating shaft. Accordingly, there is no structure interrupting a flow of air in a range of meridian angles at which the second guide shape 1352 is formed with respect to the rotating shaft.

A bearing housing 17 may be mounted and fixed onto the upper end of the motor mount 111.

<Diffuser>

A diffuser 40 may be provided on an upper side of the bearing housing 17. The diffuser 40 includes a diffuser body 41 that defines an entire appearance of the diffuser, and a vane 42 provided on an outer surface of the diffuser body 41.

The diffuser body 41 includes a flat portion 413 having a hole at a central portion thereof and having a flat shape and, and an inclined portion 411 in the shape of an inclined surface that inclines downward from an outer edge of the flat portion 413 further toward radial and outward directions. An impeller 31 is placed at an upper side of the flat portion 413. The bearing housing 17 is inserted into the hole 45.

The incline portion 411 is provided at an outer edge of the flat portion 413. A tilt angle of the incline portion may correspond to a tilt angle of a below-described impeller 31. That is, in the second implementation, the impeller 31 may be a mixed-flow type impeller, and the diffuser may also be a mixed-flow type diffuser.

The vane 42 may be provided on an upper surface of the inclined portion 411. The vane 42 may change a direction of air pressurized and fluidized in a tangential direction of a circumference by the impeller 31. The vane 42 may change a direction of air pressurized in the impeller such that motions of the air may be reduced in a circumferential direction and increased in a radial direction while the air is passing through the vane 42. Additionally, the flow of the air having passed through the vane 42 may be directed downward at a boundary between the inclined surface 343 and the cylindrical surface 344 of the impeller cover 34.

A radial outer edge of the inclined portion 411 may be distanced from the upper end of the motor mount 111. The space may constitute a cooling flow path outlet 43. According to the second implementation, the cooling flow path outlet 43 is placed further downstream of a flow of air than the diffuser 40 and the vane 42. Further, the cooling flow path outlet 43 may form the shape of a single large ring along the circumferential direction of the fan motor.

The diffuser may be placed on the lower side of the impeller 31 and on the upper side of the bearing housing 17 in the vertical or axial direction, and may be placed further outward than the impeller 31 and further inward than the body coupler 115 in the radial direction.

A lower space of the diffuser body 41 is defined by the bottom of the diffuser body 41 and the motor mount 111 as a motor accommodating space. The cooling flow path inlet 113 may be provided at the lower sides of the base member 133 and the side wall member 131 of the motor mount 111, and the cooling flow path inlet 113 may be opened toward a space of the air atmosphere.

A space between the diffuser body 41 and the impeller cover 34 is a space in which air pressurized in the impeller 31 flows fast. Accordingly, the space has a pressure lower than that of a space inside the motor mount 111. Due to the difference in pressures, air inside the motor mount 111 flows out of the motor mount 111 through the cooling flow path outlet 43, and the space inside the motor mount 111 is filled with air introduced from the cooling flow path inlet 113 again.

<Flow Path of Suctioned Air>

Like the fan motor of the first implementation, the fan motor of the second implementation may suction air through the air inlet 341 provided at the upper central portion of the impeller cover 34, and may discharge air through a space formed between the lower end of the impeller cover 34 and the motor mount 111, for example, through the air discharge opening 116 defined around the upper side of the motor housing 11.

A direction of the flow of air that is expanded and has a lower speed while the air is passing through the inclined portion 411 of the diffuser 40 is changed by the vane 42 such that the flow of air may have more radial motions, is changed by the impeller cover 34 such that the flow of air may have more downward motions again, and then is discharged while moving further downward with respect to a cross section of the air discharge opening 116.

<Flow Path of Cooling Air>

The fan motor of the second implementation naturally generates a flow of air according to a difference in pressures, and allows the air to flow to a space in which the motor part 20 is installed, thereby minimizing power consumption to cool the motor part. Additionally, the fan motor may further include the guide shape 135 to further induce the above-described flow of air.

The guide shape 135 may further facilitate feedback (a cooling flow path inlet→a lower space in a motor mount- →cooling a motor part→an upper space in the motor mount→a cooling flow path outlet→an air discharge opening→the cooling flow path inlet) of cooling air using some of the kinetic energy of air discharged through the air discharge opening 116.

In relation to the flow path of suctioned air, the cooling flow path outlet 43 formed between the diffuser 40 and the motor mount 111 communicates a space which is a flow path of suctioned air with a space in which the motor part 20 is installed. A space between the diffuser 40 and the impeller cover 34 has a pressure lower than in the space in which the motor part 20 is installed due to air pressurized by the impeller 31. Accordingly, air moves from the inside of the motor mount 111 to the outside of the motor mount 111, near the cooling flow path outlet 43. A part of air, discharged downward from the air discharge opening, is directed by the guide shape 135 of the base member 133 from a lower outer edge of the inner space of the motor mount 111 toward a central shaft thereof, then flows, and induces the air to flow upward again near a lower central portion of the inner space of the motor mount 111.

The air, flowing upward near the lower central portion of the inner space of the motor mount 111, may induce air in the lower space of the base member 133 to flow to the upper side of the base member 133 through the second cooling flow path inlet 1132. Accordingly, air outside the second cooling flow path inlet 1132 as well as air pressurized by the impeller may be introduced in the flow of the above-described feedback.

An increase in the speed of rotation of the fan motor results in an increase in the speed of a flow of air generated in the above-described way.

Certainly, when a flow of air is induced to cool the motor part as described above, power of the fan motor may also be slightly reduced. However, unlike a method of a forced flow, or a method of compelling suctioned air to pass through a space in which the motor part is installed, the above-described method may minimize a reduction in efficiency of the fan motor, and may smoothly cool the motor part.

<Housing of Vacuum Cleaner>

As an example, the fan motor may be installed in a vacuum cleaner. Considering features such as its reduced size and weight and its enhanced suction power through high-speed rotation, the fan motor may be applied to a hand-held vacuum cleaner.

The fan motor may be installed in a housing 60 of a vacuum cleaner. The housing 60 includes an upper housing 61 that covers the impeller cover 34 from an air inlet 341 of the fan motor while wrapping the impeller cover 34, and a lower housing 67 that covers the base member 133 from the cooling flow path inlet 113 of the fan motor while wrapping the base member 133. The upper housing 61 and the lower housing 67 are coupled to each other around the outer side of the fan motor.

An air suction opening 63 into which air having passed through a filter and the like is suctioned is provided on an upper side of the upper housing 61. The air suction opening 63 is matched with and disposed on the air inlet 341 of the fan motor while facing the air inlet 341 of the fan motor.

An air outlet 65 is provided around a lower side of the upper housing 61. The air outlet 65 is disposed on the air discharge opening 116 of the fan motor in a radial direction while facing the air discharge opening 116 of the fan motor.

The lower housing 67 fixes the fan motor in contact with the radial outer edge of the base member 133 while wrapping a circumference of the base member 133 of the fan motor. An extended guide shape 69 that has a shape in which the first guide shape 1351 of the base member 133 is extended further outward in a radial direction is provided in a portion in which the lower housing 67 contacts an outer circumferential surface of the base member 133. The extended guide shape 69 has a shape to which the guide shape 135 is connected. Accordingly, the extended guide shape 69 may be provided with a profile that inclines upward from the rotating shaft of the fan motor further toward radial and outward directions. Additionally, the extended guide shape 69 faces the air discharge opening 116 of the fan motor upward.

When the fan motor rotates, dust in air introduced through a nozzle of the vacuum cleaner is collected through a filter, and the air having passed through the filter is suctioned into the fan motor after passing through the air suction opening 63 of the upper housing 61 and the air inlet 341 of the impeller cover 34.

The air suctioned into the fan motor is pressurized by the impeller 31, a flow of the air is guided by the mixed-flow type diffuser 40 and the impeller cover 34, and the air is discharged to an outer space of the motor mount 111 through the air discharge opening 116.

A part of the air, discharged to the outer space of the motor mount 111 in the radial direction thereof, is discharged in the lateral direction of the housing to the atmosphere through the air outlet 65 of the housing 60, and a part of the air flows downward and is introduced into a lower side of the inner space of the motor mount 111 by the extended guide shape 69 and the first guide shape 1351.

In the implementation, a structure, in which the guide shape 135, 69 is provided from the base member 133 of the fan motor to the housing 60, is provided as an example. However, in some cases, the guide shape 135 may be provided only on the base member 133 or the guide shape 69 may be provided only on the housing 60.

The present disclosure described above may be variously substituted, altered, and modified by those skilled in the art to which the present disclosure pertains without departing from the scope and sprit of the present disclosure. Therefore, the present disclosure is not limited to the above-mentioned exemplary implementations and the accompanying drawings.

What is claimed is:

1. A fan motor for a vacuum cleaner, comprising:

a motor mount that defines an inner space therein;

a motor part accommodated in the inner space of the motor mount; and an impeller disposed at an upper side of the motor mount and configured to be rotated by the motor part;

wherein the motor mount defines:

an air discharge opening configured to discharge air discharged from the impeller to an outer space of the motor mount, a cooling flow path outlet that is disposed at the upper side of the motor mount and that is disposed between the impeller and the air discharge opening, and a first cooling flow path inlet that is disposed at a position vertically below the air discharge opening and the cooling flow path outlet and that is configured to re-introduce, into the inner space of the motor mount, at least a portion of the air discharged through the air discharge opening, wherein the fan motor further comprises a guide that is configured to direct, in an upward direction, at least a portion of the air re-introduced into the inner space of the motor mount through the first cooling flow path inlet, and wherein at least a portion of each of the first cooling flow path inlet and the guide vertically faces the air discharge opening.

2. The fan motor of claim 1, wherein the motor mount further defines a second cooling flow path inlet, and wherein the guide has a first end adjacent to the first cooling flow path inlet and a second end disposed closer to the second cooling flow path inlet than to the first cooling flow path inlet.

3. The fan motor of claim 2, wherein the first end of the guide is disposed radially outward of the second end of the guide.

4. The fan motor of claim 1, further comprising:

an impeller cover that covers the impeller, that is disposed at the upper side of the motor mount, and that defines an air inlet at an upper central portion of the impeller cover, wherein the air discharge opening is defined at a lower edge of the impeller cover.

5. The fan motor of claim 1, wherein the motor mount comprises:

a base member that is disposed at a lower side of the motor mount and that comprises the guide, the base member having a first radius with respect to a center of the motor mount; and a side wall member that extends upward from the base member, the side wall member having a second radius less than the first radius with respect to the center of the motor mount.

6. A fan motor for a vacuum cleaner, comprising:

a motor part configured to generate rotational force;

a motor mount that defines an inner space accommodating the motor part therein and that defines a first cooling flow path inlet at a lateral side of the motor mount for cooling heat generated by the motor part;

an impeller disposed at an upper side of the motor part and configured to be rotated by the rotational force generated by the motor part; and an impeller cover that covers the impeller, that is disposed at the upper side of the motor mount, and that defines an air inlet at an upper central portion of the impeller cover, wherein the motor mount further defines:

an air discharge opening opened to an outside of the motor mount and configured to discharge, to the outside of the motor mount, air introduced through the air inlet of the impeller cover and pressurized by the impeller, and a cooling flow path outlet that is disposed at the upper side of the motor mount and that is open to a space defined between the impeller and the air discharge opening, wherein the first cooling flow path inlet is configured to re-introduce, into the motor part, at least a portion of the air discharged through the air discharge opening, wherein the motor mount comprises a guide that is configured to guide, toward the motor part, at least part of the air re-introduced into the motor mount through the first cooling flow path inlet, and wherein at least a portion of each of the first cooling flow path inlet and the guide vertically faces the air discharge opening.

7. The fan motor of claim 6, wherein the motor mount further comprises a side wall member that defines a lateral surface of the motor mount, wherein the cooling flow path outlet is disposed radially outward of the side wall member, and wherein the first cooling flow path inlet is disposed at a lower side of the cooling flow path outlet.

8. The fan motor of claim 7, wherein the motor mount comprises:

a base member disposed at a lower side of the motor mount, the base member having a first radius with respect to a center of the motor mount, the first radius being greater than a second radius of the side wall member with respect to the center of the motor mount, and wherein the guide comprises a first guide that is inclined upward and radially outward with respect to the base member and that extends radially outward from the base member to face at least a portion of the air discharge opening.

9. The fan motor of claim 8, wherein the guide further comprises a second guide that is disposed radially inward of the base member and the first guide and that is inclined upward with respect to the base member.

10. The fan motor of claim 9, wherein the motor mount further defines:

a second cooling flow path inlet that faces a radial inner end of the second guide and that is disposed between the radial inner end of the second guide and the center of the motor mount.

11. The fan motor of claim 6, wherein the motor mount further comprises:

a side wall member that defines a lateral side surface of the motor mount, that accommodates the motor part, and that fixes the motor part in a radial direction;

a plurality of extended arm members that extend downward from the side wall member and outward in the radial direction, the plurality of extended arm members being spaced apart from one another to define the first cooling flow path inlet; and a base member connected to a lower side of each of the plurality of extended arm members, the base member comprising the guide.

12. The fan motor of claim 11, wherein the cooling flow path outlet is defined at a position radially outward of the side wall member, and wherein the first cooling flow path inlet is configured to provide at least part of the air flows through the cooling flow path outlet and the air discharge opening.

13. The fan motor of claim 12, wherein the motor mount further comprises:

a bearing support disposed at a lower central portion of the motor mount; and a plurality of connecting members that connect the bearing support and the base member to each other.

14. The fan motor of claim 13, wherein the motor mount further defines one or more second cooling flow path inlets between the plurality of connecting members.

15. A vacuum cleaner comprising:

a housing; and a fan motor accommodated in the housing, the fan motor comprising:

a motor part, a motor mount that defines an inner space accommodating the motor part, and an impeller disposed at an upper side of the motor mount and configured to be rotated by the motor part, wherein the motor mount defines:

an air discharge opening configured to discharge air discharged from the impeller to an outer space of the motor mount, a cooling flow path outlet that is disposed at the upper side of the motor mount and that is disposed between the impeller and the air discharge opening, and a first cooling flow path inlet that is disposed vertically below the air discharge opening and the cooling flow path outlet and that is configured to re-introduce, into the inner space of the motor mount, at least a portion of the air discharged through the air discharge opening, wherein the fan motor further comprises a guide that is configured to direct, to an upward direction, at least a portion of the air re-introduced into the inner space of the motor mount through the first cooling flow path inlet, and wherein at least a portion of each of the first cooling flow path inlet and the guide vertically faces the air discharge opening.

16. The vacuum cleaner of claim 15, wherein the housing further comprises:

an extended guide disposed outside the guide and contacts an outer surface of the guide.

17. The vacuum cleaner of claim 16, wherein the extended guide has a profile that is inclined upward with respect to a bottom surface of the housing and that extends radially outward of the guide.

18. The vacuum cleaner of claim 16, wherein the fan motor further comprises an impeller cover that covers the impeller and that is disposed at the upper side of the motor mount, and wherein the housing comprises:

an upper housing that accommodates the impeller cover; and a lower housing that accommodates a lower end of the motor mount and that comprises the extended guide.

19. The vacuum cleaner of claim 15, wherein the housing defines an air outlet that is disposed between the air discharge opening and the guide in an axial direction of the fan motor, the air outlet being configured to discharge at least part of the air discharged through the air discharge opening, and wherein the air outlet is disposed radially outward of the guide in a radial direction of the fan motor.

20. The vacuum cleaner of claim 19, wherein the air outlet is opened in the radial direction of the fan motor.

* * * * *